US009447571B2

(12) United States Patent
Yihua

(10) Patent No.: US 9,447,571 B2
(45) Date of Patent: Sep. 20, 2016

(54) AUTOMATIC FLUSHING MECHANISM

(71) Applicant: Shanghai Kohler Electronics, Ltd., Shanghai (CN)

(72) Inventor: Wang Yihua, Shanghai (CN)

(73) Assignee: SHANGHAI KOHLER ELECTRONICS, LTD., Shanghai (CN)

( * ) Notice: Subject to any disclaimer, the term of this patent is extended or adjusted under 35 U.S.C. 154(b) by 0 days.

(21) Appl. No.: 14/673,368

(22) Filed: Mar. 30, 2015

(65) Prior Publication Data

US 2015/0275493 A1 Oct. 1, 2015

(30) Foreign Application Priority Data

Mar. 31, 2014 (CN) ..... 2014 1 0127562

(51) Int. Cl.
*E03D 5/10* (2006.01)
*E03F 5/10* (2006.01)

(52) U.S. Cl.
CPC ..... *E03D 5/10* (2013.01); *E03F 5/105* (2013.01)

(58) Field of Classification Search
CPC ..... E03D 5/02; E03D 5/022; E03D 5/024; E03D 5/026; E03D 5/04; E03D 5/06; E03D 5/08; E03D 5/09; E03D 5/092; E03D 5/094; E03D 5/10; E03D 5/105; E03D 5/12
See application file for complete search history.

(56) References Cited

U.S. PATENT DOCUMENTS

2005/0217014 A1* 10/2005 Hung ..... E03D 5/105 4/405
2014/0289946 A1* 10/2014 Tanimoto ..... E03D 5/094 4/405

* cited by examiner

*Primary Examiner* — Janie Loeppke
(74) *Attorney, Agent, or Firm* — Foley & Lardner LLP

(57) ABSTRACT

An automatic flushing mechanism includes an electronic control box containing a motor and an intermittent motion gear coupled to a rotation shaft of the motor. The intermittent motion gear is configured to rotate when the motor is operated. The intermittent motion gear includes a toothed portion including a plurality of gear teeth. The automatic flushing mechanism includes an intermittent motion pendulum rod including a first end pivotally attached to the electronic control box via a rotation shaft, a second end coupled to a flush valve, and a curved rack including a plurality of rack teeth which mesh with the gear teeth of the intermittent motion gear. Rotation of the intermittent motion gear causes the curved rack to be lifted upward, thereby rotating the intermittent motion pendulum rod about the rotation shaft and lifting the flush valve.

17 Claims, 5 Drawing Sheets

AUTOMATIC FLUSHING MECHANISM

CROSS-REFERENCE TO RELATED PATENT APPLICATIONS

This application claims the benefit of and priority to Chinese Patent Application No. 201410127562.2 filed Mar. 31, 2014, the entirety of which is incorporated by reference herein.

BACKGROUND

The present invention relates generally to smart bathroom products, and more particularly to an automatic flushing mechanism for a smart bathroom product such as an electronically actuated toilet.

Some toilets include a tank which serves as a reservoir of flush water for the toilet. A flush valve is typically located at the bottom of the tank. The flush valve can be displaced via a flush actuating mechanism (e.g., a chain attached to a user-operable handle) to allow the flush water to flow through an opening covered by the flush value and into the base of the toilet. Automatic toilets may replace the user-operable handle with a motor or other automatic flush actuating mechanism.

Some existing flush actuating mechanisms employ a turntable which is rotated in a circular motion. A traction chain generally connects the turntable to the flush valve. Due to the circular motion of the turntable, the traction chain may not move straight up and down during operation. For example, when the flush valve is in a closed position, the angle of the force applied by the traction chain may be oblique. The circular motion of the turntable may also cause the closing speed of the flush value to be slow. Such existing flush actuating mechanisms may be incapable of achieving a rapid closure of the flush value (similar to that achieved by manual operation), leading to the problem of water leakage as the flush valve cannot be closed tightly.

SUMMARY

One implementation of the present disclosure is an automatic flushing mechanism for a toilet. The toilet includes a water tank and a flush valve configured to be lifted from a bottom of the water tank to release flush water from the water tank. The automatic flushing mechanism includes an electronic control box containing a motor and an intermittent motion gear coupled to a rotation shaft of the motor. The intermittent motion gear is configured to rotate when the motor is operated. The intermittent motion gear includes a toothed portion including a plurality of gear teeth. The automatic flushing mechanism includes an intermittent motion pendulum rod including a first end pivotally attached to the electronic control box via a rotation shaft, a second end coupled to the flush valve, and a curved rack including a plurality of rack teeth which mesh with the gear teeth of the intermittent motion gear. Rotation of the intermittent motion gear causes the curved rack to be lifted upward, thereby rotating the intermittent motion pendulum rod about the rotation shaft and lifting the flush valve. In some embodiments, the automatic flushing mechanism is located within the water tank.

In some embodiments, the intermittent motion gear includes a smooth toothless root portion along a rim of the intermittent motion gear in series with the toothed portion. In some embodiments, a gap is formed between the smooth toothless root portion and the curved rack when the smooth toothless portion faces the curved rack.

In some embodiments, the intermittent motion gear rotates through a cycle including a lifting phase and a falling phase. During the lifting phase, the toothed portion meshes with the curved rack and causes the curved rack to be lifted upward as the intermittent motion gear rotates. During the falling phase, the smooth toothless root portion faces toward the curved rack and the intermittent motion gear is separated from the curved rack, causing the curved rack to fall downward.

In some embodiments, the intermittent motion gear includes a toothless top portion along a rim of the intermittent motion gear in series with the toothed portion. In some embodiments, distance from an outer edge of the toothless top portion to a center of the intermittent motion gear is greater than a distance from the rim of the intermittent motion gear to the center of the intermittent motion gear. In some embodiments, a bottom tooth of the curved rack remains in contact with and slides along the toothless top portion as the intermittent motion gear rotates after the bottom tooth disengages from the toothed portion.

In some embodiments, the intermittent motion gear rotates through a cycle including a lifting phase and a holding phase. During the lifting phase, the toothed portion meshes with the curved rack and causes the curved rack to be lifted upward as the intermittent motion gear rotates. During the holding phase, the toothless top portion holds the curved rack in a lifted position. In some embodiments, the cycle further includes a falling phase during which the intermittent motion gear disengages from the curved rack, causing the curved rack to fall downward.

In some embodiments, the intermittent motion gear rotates in a first rotational direction. The intermittent motion pendulum rod may initially rotate in a second rotational direction opposite the first rotational direction as the intermittent motion gear rotates in the first rotational direction. The intermittent motion pendulum rod may then switch to rotate in the first rotational direction as the intermittent motion gear continues to rotate in the first direction.

Another implementation of the present disclosure is an automatic flushing mechanism. The automatic flushing mechanism includes an electric appliance control box containing a motor. The automatic flushing mechanism includes an intermittent motion gear including a toothed portion provided along a rim of the intermittent motion gear. The toothed portion includes at least one gear tooth. The intermittent motion gear is driven by the motor. The automatic flushing mechanism further includes an intermittent motion pendulum rod connected, on one end thereof, to a flush valve through a chain. The intermittent motion pendulum rod is connected, on another end thereof, to a rotation shaft which is fixed on the electric appliance control box. The intermittent motion pendulum rod is rotated around the rotation shaft and includes a curved rack which meshes with the toothed portion of the intermittent motion gear.

In some embodiments, the intermittent motion pendulum rod is provided with a groove which contains the intermittent motion gear. The curved rack may be provided on one side of the groove.

In some embodiments, the automatic flushing mechanism includes a position-limit device which is fixed on the electric appliance control box and limits movement of the intermittent motion pendulum rod.

In some embodiments, the intermittent motion gear includes a smooth toothless root portion along the rim of the intermittent motion gear. In some embodiments, a gap is formed between the smooth toothless root portion and the curved rack.

In some embodiments, the intermittent motion gear is rotated until the toothed portion meshes with the curved rack. A tooth top arc of a first gear tooth which the toothed portion adopts to mesh with the curved rack may be greater than a tooth top arc of any other gear tooth of the toothed portion. A tooth top arc of a second rack tooth which the curved rack adopts to mesh with the toothed portion may be greater than a tooth top arc of any other rack tooth of the curved rack.

In some embodiments, the intermittent motion gear includes a smooth toothless top portion adjacent to the toothed portion along the rim of the intermittent motion gear. In some embodiments, a distance from an edge of the toothless top portion to a center of the intermittent motion gear is greater than a distance from the rim of the intermittent motion gear to center of the intermittent motion gear. In some embodiments, a bottom tooth of the curved rack remains in contact with and slides along the toothless top portion as the intermittent motion gear rotates after the bottom tooth disengages from the toothed portion. In some embodiments, the toothless top portion occupies between one-half and three-fourths of the rim of the intermittent motion gear Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
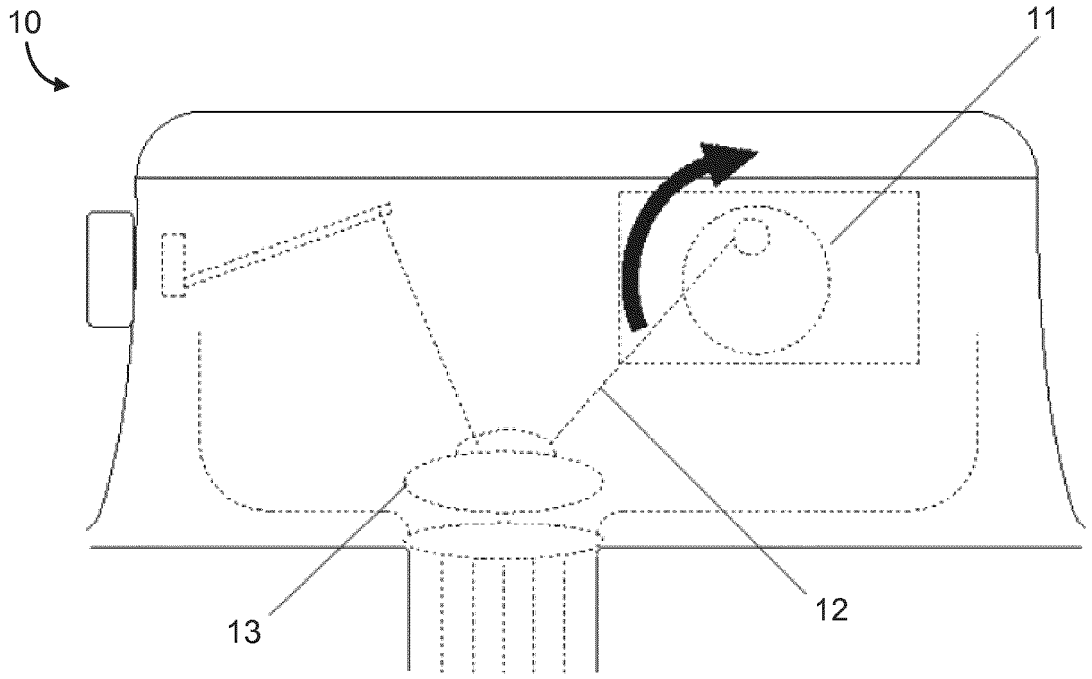
FIG. 1 (prior art)
FIG. 1 is a structural diagram of a prior art flushing mechanism, according to an exemplary embodiment.

Referring to FIG. 1, a drawing of a prior art flush actuating mechanism 10 is shown, according to an exemplary embodiment. Flush actuating mechanism 10 includes a turntable 11 and a traction chain 12 connecting turntable 11 to a flush valve 13 (e.g., a sealed float ball). In operation, turntable 11 rotates clockwise (as shown in FIG. 1), which causes traction chain 12 to pull on flush valve 13 and displace flush valve 13 from a closed position. As turntable 11 continues to rotate past the central point, traction chain 12 relaxes and allows flush valve 13 to return to the closed position. The angle of the force applied by traction chain 12 to flush valve 13 is oblique, which prevents flush valve 13 from moving straight up and down. Further, the circular motion of turntable 11 causes the falling speed of flush valve 13 to be slow. Water leakage may occur as the flush valve 13 cannot be closed tightly.

Figure 2:
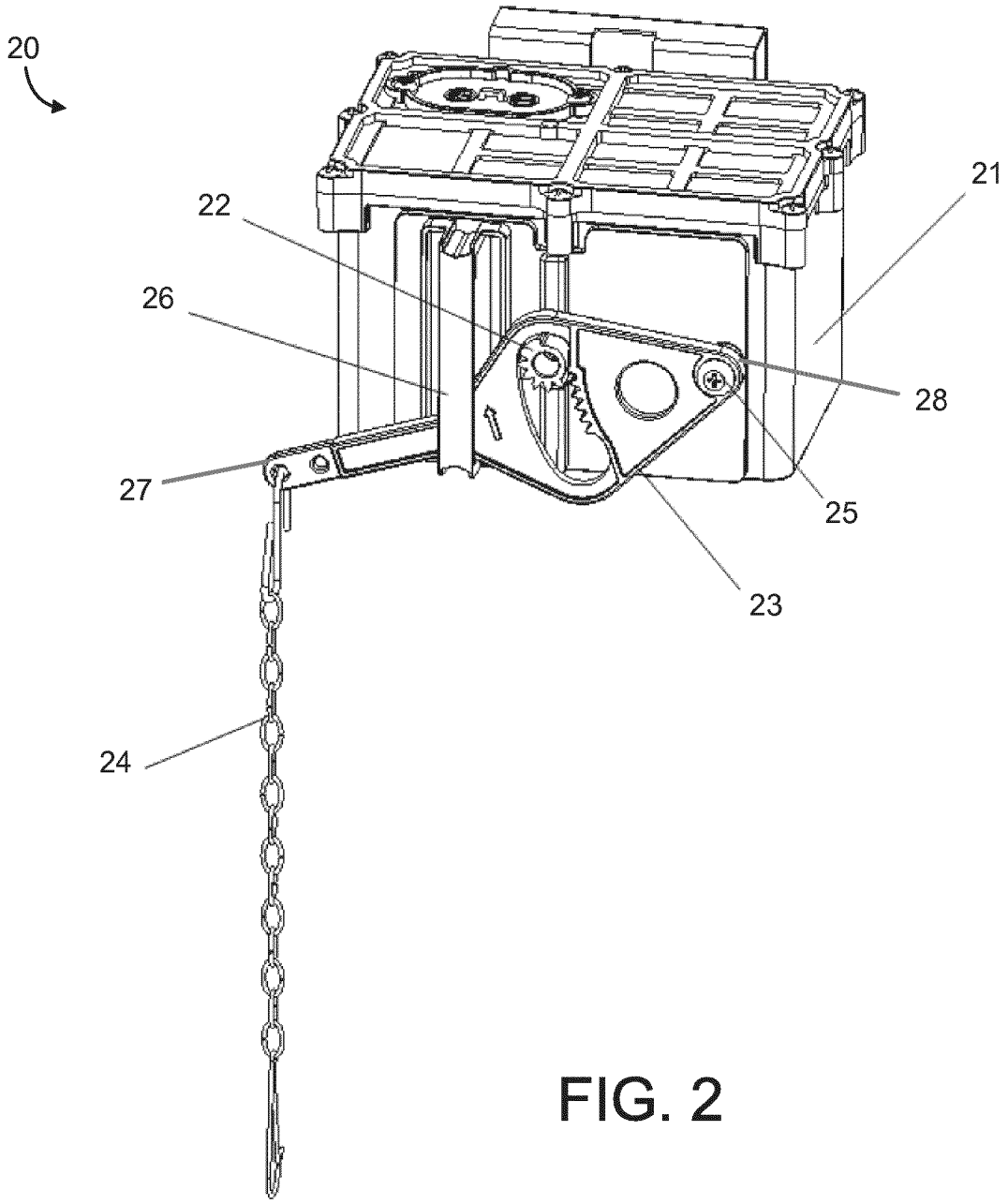
FIG. 2 is a structural diagram of an automatic flushing mechanism of the present invention including an intermittent motion gear and an intermittent motion pendulum rod, according to an exemplary embodiment.

Referring now to FIG. 2, a structural diagram of an automatic flushing mechanism 20 of the present invention is shown, according to an exemplary embodiment. In some embodiments, automatic flushing mechanism 20 is located within the water storage tank of a toilet. Flushing mechanism 20 is shown to include a gearbox 21, an intermittent motion gear 22, and an intermittent motion pendulum rod 23. In some embodiments, gearbox 21 is an electric appliance control mechanical reduction gearbox. For example, gearbox 21 may include a motor, an electric appliance control module, and/or a power supply unit. The power supply unit may receive power from an external power source or an internal power storage device. The electric appliance control module may include a wireless signal receiving unit (e.g., a sensor), a drive unit connected to the motor, and/or a trip switch. The power supply unit may supply power to the drive unit and the wireless signal receiving unit. The drive unit may be connected to the wireless signal receiving unit. The wireless signal receiving unit may receive an external wireless signal and may cause the drive unit to drive the motor in response to the wireless signal.

In some embodiments, automatic flushing mechanism 20 is used in cooperation with an independent sensor trigger. The external wireless signal may be a signal that a user has finished using the toilet. For example, the wireless signal may be provided by a proximity sensor and/or motion sensor installed on or near the toilet. When a user finishes using the toilet, a signal may be sent automatically from the sensor. Alternatively, the signal may come from a button that is pressed by the user when the user finishes using the toilet. With a wireless signal, it is not necessary to connect automatic flushing mechanism 20 to the external button through a wire. Upon receiving the signal from the button and/or wireless sensor, the wireless signal receiving unit may cause the drive unit to operate (e.g., rotate), thereby triggering the flushing operation. In some embodiments, the motor rotates through one complete revolution when a flushing operation is triggered.

Still referring to FIG. 2, intermittent motion gear 22 may be fixed to a rotating shaft of the motor and may rotate when the motor is operated. An end 27 of intermittent motion pendulum rod 23 may be connected to a flush valve (not shown) by a chain 24. An opposite end 28 of intermittent motion pendulum rod 23 may be connected to a rotation shaft 25. Rotation shaft 25 may be fixed to gearbox 21. Intermittent motion pendulum rod 23 may be configured to rotate relative to gearbox 21 around rotation shaft 25. The interaction between intermittent motion gear 22 and intermittent motion pendulum rod 23 may cause automatic flushing of the toilet, as described with reference to FIGS. 3-7.

Figure 3:
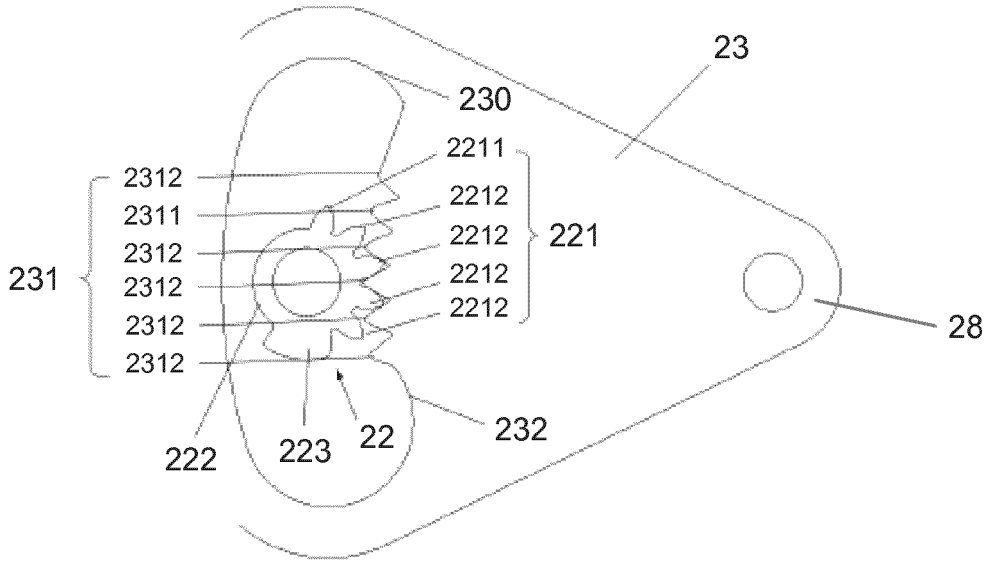
FIG. 3 is a partially enlarged view of the intermittent motion gear and the intermittent motion pendulum rod of FIG. 2, according to an exemplary embodiment.

Referring now to FIG. 3, a partially enlarged view of intermittent motion gear 22 and intermittent motion pendulum rod 23 is shown, according to an exemplary embodiment. Intermittent motion gear 22 may be driven (i.e., rotated) by a motor contained within gearbox 21. Intermittent motion gear 22 is shown to include a toothed portion 221 along a rim of intermittent motion gear 22. Toothed portion 221 may include at least one gear tooth 2211-2212. Intermittent motion pendulum rod 23 is shown to include a curved rack 231. Curved rack 231 may include at least one rack tooth 2311-2312 and may be configured to mesh with toothed portion 221 of intermittent motion gear 22.

In operation, intermittent motion gear 22 is rotated in a counter-clockwise direction (as shown in FIG. 3). When toothed portion 221 meshes with curved rack 231, curved rack 231 is moved upward by the rotation of intermittent motion gear 22. The upward motion of curved rack 231 causes intermittent motion pendulum rod 23 to rotate (e.g., in a clockwise direction as shown in FIG. 3) around rotation shaft 25. The rotation of intermittent motion pendulum rod 23 moves end 27 upward, which causes chain 24 to pull the flush valve upward. As intermittent motion gear 22 continues to rotate in the counter-clockwise direction, toothed portion 221 disengages from curved rack 231. When toothed portion 221 disengages from curved rack 231, intermittent pendulum rod 23 is no longer supported by the gear tooth meshing, which causes intermittent motion pendulum rod 23 to rapidly drop (e.g., rotate in a counter-clockwise direction around rotation shaft 25), thereby returning the flush valve to the closed position.

Figure 4:
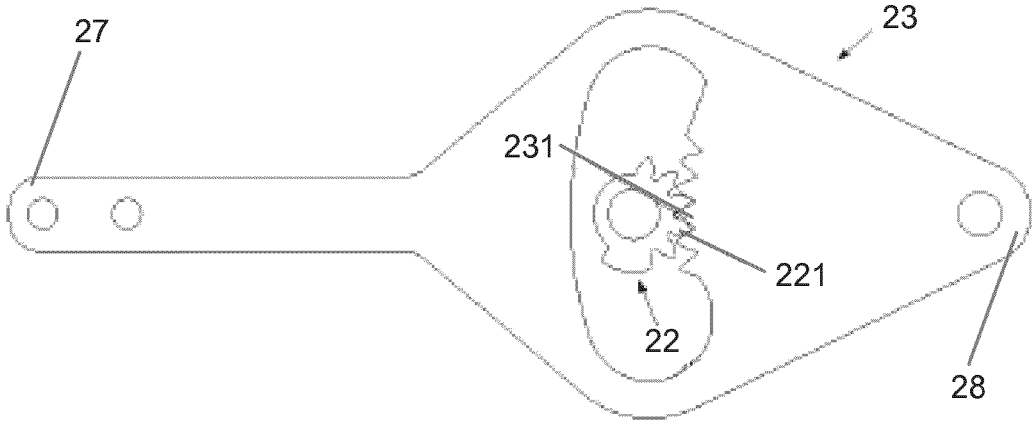
FIG. 4 is another view of the intermittent motion gear and the intermittent motion pendulum rod of FIG. 2, showing the intermittent motion gear meshing with a curved rack of the intermittent motion pendulum rod, according to an exemplary embodiment.
Figure 5:
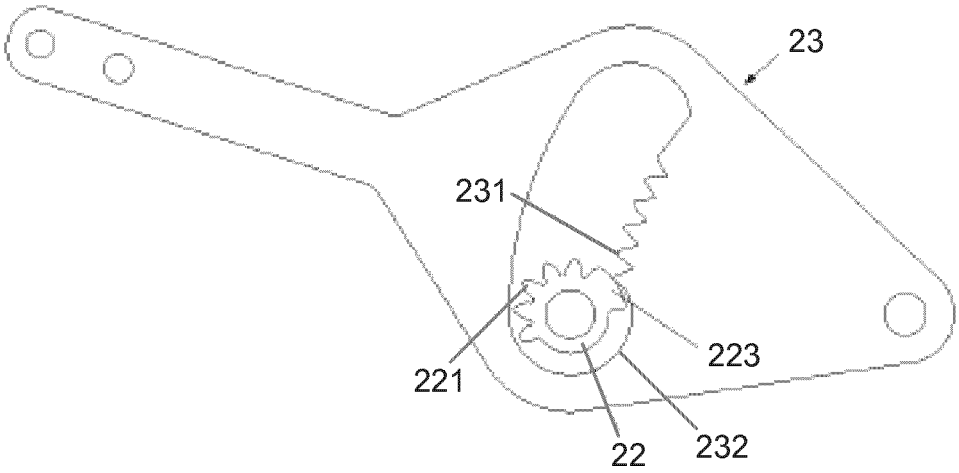
FIG. 5 is another view of the intermittent motion gear and the intermittent motion pendulum rod of FIG. 2, showing a toothless top portion of the intermittent motion gear supporting the curved rack and holding the intermittent motion pendulum rod in a raised position, according to an exemplary embodiment.
Figure 6:
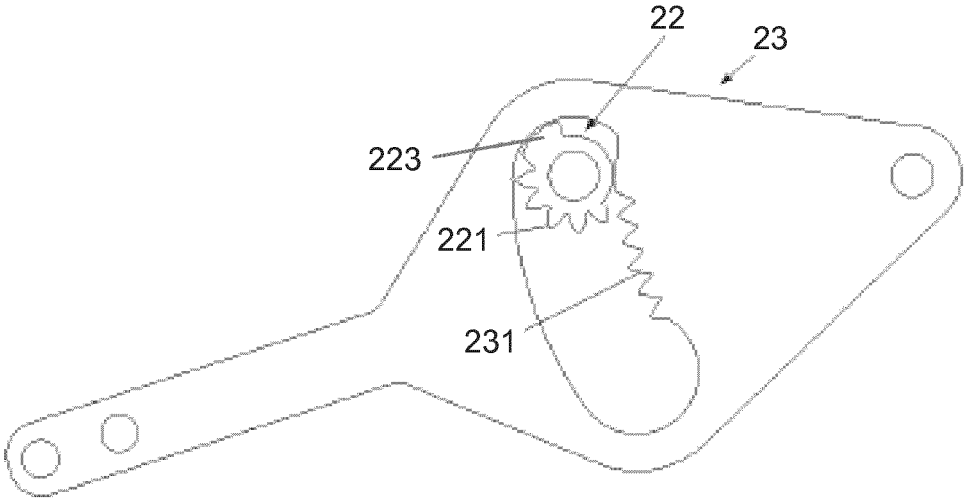
FIG. 6 is another view of the intermittent motion gear and the intermittent motion pendulum rod of FIG. 2, showing a toothless root portion of the intermittent motion gear facing the curved rack, which allows the intermittent motion pendulum rod to drop into a closed position, according to an exemplary embodiment.

Referring now to FIGS. 4-6, schematic diagrams illustrating the interaction between intermittent motion gear 22 and curved rack 231 are shown, according to an exemplary embodiment. From the perspective shown in FIGS. 4-6, intermittent motion gear 22 is rotated in a counter-clockwise direction. Toothed portion 221 meshes with curved rack 231 to drive intermittent motion pendulum rod 23 to be rotated around rotation shaft 25 in a clockwise direction. The rotation of intermittent motion pendulum rod 23 lifts intermittent motion pendulum rod 23 from the intermediate position shown in FIG. 4 to the raised position shown in FIG. 5. Intermittent motion pendulum rod 23 is connected to chain 24, which causes chain 24 to lift up the flush valve as intermittent motion pendulum rod 23 is raised.

As intermittent motion pendulum rod 23 moves into the raised position (shown in FIG. 5), intermittent motion gear 22 arrives at the bottom of curved rack 231. As intermittent motion gear 22 continues to rotate in the counter-clockwise direction, toothed portion 221 becomes separated from curved rack 231. Upon toothed portion 221 separating from curved rack 231, intermittent motion pendulum rod 23 loses support and falls (e.g., rotates in the counter-clockwise direction around rotation shaft 25) from the raised position shown in FIG. 5 to the closed position shown in FIG. 6.

As intermittent motion pendulum rod 23 falls, chain 24 loses upward the pulling force provided by intermittent motion pendulum rod 23, which causes the flush valve to rapidly fall (e.g., due to gravity) into a closed position at the bottom of the water tank. Advantageously, the impact force of falling facilitates complete closing of the flush valve and prevents leakage from occurring. FIG. 6 shows the rotational position of intermittent motion gear 22 after intermittent motion pendulum rod 23 falls into the closed position. In the closed position, toothed portion 221 may be completely separated from curved rack 231.

Referring again to FIG. 3, intermittent motion gear 22 is shown to include a smooth toothless root portion 222 along a rim of intermittent motion gear 22. In operation, intermittent motion gear 22 may rotate until toothless root portion 222 faces curved rack 231. When toothless root portion 222 faces curved rack 231, toothed portion 221 of intermittent motion gear 22 may be completely separated from curved rack 231. In other embodiments, the separation between toothed portion 221 of intermittent motion gear 22 and curved rack 231 may be achieved in other ways. For instance, equipment may be provided to laterally move the motor, so that after intermittent motion gear 22 causes intermittent motion pendulum rod 23 to lift by a predetermined amount, the motor may be laterally moved to separate toothed portion 221 from curved rack 231. However, the separation between toothed portion 221 and curved rack 231 provided by the present invention (e.g., by toothless root portion 222) may be smoother than any separation resulting from lateral motion of the motor and may be achieved without additional equipment required to effect such lateral motion.

In some embodiments, a gap is provided between toothless root portion 222 and curved rack 231. The gap between toothless root portion 222 and curved rack 231 may be described by the equation: $L_{MR}>L_R+L_M$, where $L_{MR}$ is the total distance between the center of intermittent motion gear 22 and the center of rotation shaft 25, $L_R$ is the distance between the tooth top of curved rack 231 and the center of rotation shaft 25, and $L_M$ is the distance between toothless root portion 222 and the center of intermittent motion gear 22. The difference between $L_{MR}$ and $L_R+L_M$ represents the width of the gap.

In some embodiments, intermittent motion gear 22 and curved rack 231 have a tooth pressure angle of approximately 25°~45°. The standard tooth pressure angle may be approximately 20°. Since the standard tooth top is wide, a standard tooth may mesh without interference in normal operation. However, since intermittent motion gear 22 lacks teeth along its entire circumference, interference problems could potentially occur if the tooth top is too wide. To prevent any potential interference from occurring, the present invention may use a tooth pressure angle (e.g., approximately 25°~45°) that is greater than the standard tooth pressure angle of approximately 20°.

Still referring to FIG. 3, intermittent motion gear 22 is shown to include a first gear tooth 2211 and a plurality of other gear teeth 2212. First gear tooth 2211 may be the first tooth of intermittent motion gear 22 to mesh with curved rack 231 when intermittent motion gear 22 is rotated in a counter-clockwise direction (as shown in FIG. 3). In some embodiments, the tooth top arc (i.e., tip radius) of first gear tooth 2211 is greater than the tooth top arcs of the other gear teeth 2212. For example, if intermittent motion gear 22 has a gear modulus of one (1), first gear tooth 2211 may have a tooth top arc within a range of approximately 0.4 to approximately 0.6. The other gear teeth 2212 may have tooth top arcs of approximately 0.35 or less. In other words, first gear tooth 2211 may have a sharper tip relative to the other gear teeth 2212.

Similarly, curved rack 231 is shown to include a second rack tooth 2311 and a plurality of other rack teeth 2312. Second rack tooth 2311 may be configured to mesh between first gear tooth 2211 and the adjacent gear tooth 2212. In some embodiments, the tooth top arc of second rack tooth 2311 is greater than the tooth top arcs of the other rack teeth 2312. For example, second rack tooth 2311 may have a tooth top arc within a range of approximately 0.4 to approximately 0.6. The other rack teeth 2312 may have tooth top arcs of approximately 0.35 or less. In other words, second rack tooth 2311 may have a sharper tip relative to the other rack teeth 2312.

In some embodiments, the mesh between intermittent motion gear 22 and curved rack 231 is a flat top mesh. For example, intermittent motion gear 22 may include flat top teeth that are easily held out against each other when they move face to face. In some embodiments, the first gear tooth 2211 has a sharpened tooth top shape relative to the other gear teeth 2212 to ensure that intermittent motion gear 22 will achieve a smooth starting mesh with curved rack 231 and to prevent intermittent motion gear 22 from becoming stuck. These features may advantageously ensure a reliable starting mesh between toothed portion 221 and curved rack 231.

Still referring to FIG. 3, in some embodiments, intermittent motion gear 22 includes a smooth toothless top portion 223 along a rim of intermittent motion gear 22. Smooth toothless top portion may be adjacent to toothed portion 221 and may follow toothed portion 221 as intermittent motion gear 22 is rotated relative to curved rack 231. In some embodiments, the distance from the outer edge of toothless top portion 223 to the center of intermittent motion gear 22 is greater than the distance from the rim of intermittent motion gear 22 (i.e., the edge of toothless root portion 222) to the center of intermittent motion gear 22. In other words, toothless top portion 223 may protrude from intermittent motion gear 22 relative to toothless root portion 222.

In operation, intermittent motion gear 22 may be driven by the motor (i.e., rotated) into the rotational position shown in FIG. 5. In the position shown in FIG. 5, toothed portion 221 is completely separated from curved rack 231 and toothless top portion 223 functions to support and position-limit intermittent motion pendulum rod 23. In some embodiments, toothless top portion 223 supports the bottom tooth of rack teeth 2312. Intermittent motion gear 22 may be rotated counter-clockwise through the position shown in FIG. 5 and into the position shown in FIG. 6. As intermittent motion gear 22 is rotated, toothless top portion 223 may be separated from curved rack 231, which causes intermittent motion pendulum rod 23 to fall down (i.e., rotate about rotation shaft 25) into the position shown in FIG. 6.

Advantageously, the features provided by intermittent motion gear 22 and intermittent motion pendulum rod 23 simulate the functioning of a manually-operable handle. For example, toothless top portion 223 functions to hold intermittent motion pendulum rod 23 in the elevated position shown in FIG. 5 as intermittent motion gear 22 continues to rotate after toothed portion 221 is separated from curved rack 231. In some embodiments, intermittent motion pendulum rod 23 is held in the elevated position for the duration of a stopping time period $T_s$. The stopping time period $T_s$ may be defined by the equation $T_s$=Range×$T_t$, where Range is the percentage of the perimeter of intermittent motion gear that is covered by toothless top portion 223, and $T_t$ is the period of rotation for intermittent motion gear 22 (i.e., the time required for intermittent motion gear 22 to rotate through a complete circle). In some embodiments, the Range of toothless top gear 233 is approximately ½ to approximately ¾. By adjusting the Range of toothless top portion 223 along the perimeter of intermittent motion gear 22, the stopping time period $T_s$ can be adjusted, so as to meet different flushing water requirements (i.e., by increasing or decreasing the duration for which the flush valve is held open).

In some embodiments, the last tooth of curved rack 231 (i.e., the bottom tooth of curved rack 231) continues to contact toothless top portion 223 after the mesh is disengaged. The last tooth of curved rack 231 may slide along toothless top portion 223 until the rotation of intermittent motion gear 22 separates the last tooth from toothless top portion 223. As shown in FIG. 5, the last tooth of curved rack 231 may extend to form an arc 232 which contains the rotation of toothless top portion 233. The last tooth of curved rack 231 may be the final tooth that meshes with toothed portion 221 before toothed portion 221 is separated from curved rack 231.

Referring again to FIGS. 2-3, intermittent motion pendulum rod 23 is shown to include a groove 230 which contains intermittent motion gear 22. In some embodiments, curved rack 231 is located on one side of groove 230. When intermittent motion pendulum rod 23 falls (e.g., rotates about rotation shaft 25) into the closed position shown in FIG. 6, intermittent motion gear 22 may engage groove 230. Intermittent motion gear 22 supports groove 230 and thus stops the falling of intermittent motion pendulum rod 23. Hence, groove 230 exerts a position-limit function while containing intermittent motion gear 22.

In some embodiments, automatic flushing mechanism 20 includes an additional position-limit device 26. Position limiting device 26 may be fixed on gearbox 21 to limit the shaking and swinging of intermittent motion pendulum rod 23. In some embodiments, position-limit device 26 is cross-connected on one side of intermittent motion pendulum rod 23, and fixed to gearbox 21.

Figure 7:
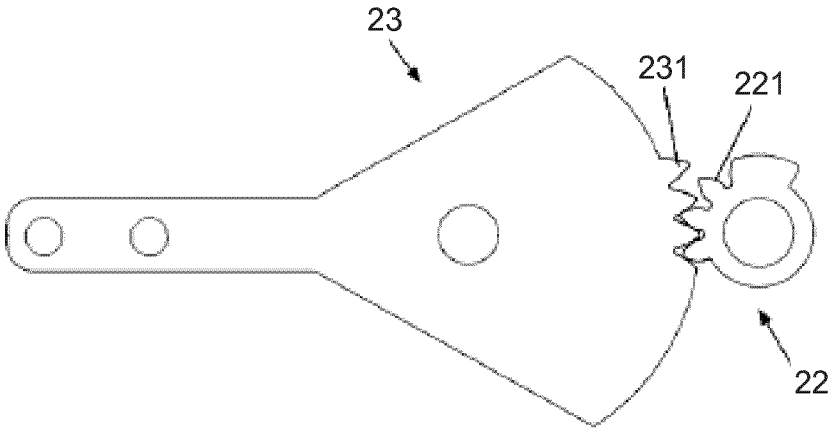
FIG. 7 is a partially enlarged view of another embodiment of the intermittent motion gear and the intermittent motion pendulum rod, according to an exemplary embodiment.

Referring now to FIG. 7, an alternative embodiment of intermittent motion pendulum rod 23 and intermittent motion gear 22 is shown. In the embodiment shown in FIG. 7, one side of intermittent motion pendulum rod 23 is used as curved rack 231. Intermittent motion gear 22 and toothed portion 221 may be provided outside the intermittent motion pendulum rod 23 and positioned to mesh with curved rack 231.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

What is claimed is:

1. An automatic flushing mechanism for a toilet that includes a water tank and a flush valve configured to be lifted from a bottom of the water tank to release flush water from the water tank, the automatic flushing mechanism comprising:

an electronic control box containing a motor;

an intermittent motion gear coupled to a rotation shaft of the motor and configured to rotate when the motor is operated, the intermittent motion gear comprising a toothed portion including a plurality of gear teeth;

an intermittent motion pendulum rod comprising a first end pivotally attached to the electronic control box via a rotation shaft, a second end coupled to the flush valve, and a curved rack including a plurality of rack teeth which mesh with the gear teeth of the intermittent motion gear;

wherein rotation of the intermittent motion gear causes the curved rack to be lifted upward, thereby rotating the intermittent motion pendulum rod about the rotation shaft and lifting the flush valve;

wherein the intermittent motion gear comprises a toothless top portion along a rim of the intermittent motion gear in series with the toothed portion;

wherein a bottom tooth of the curved rack remains in contact with and slides along the toothless top portion as the intermittent motion gear rotates after the bottom tooth disengages from the toothed portion.

2. The automatic flushing mechanism of claim 1, wherein the intermittent motion gear comprises a smooth toothless root portion along a rim of the intermittent motion gear in series with the toothed portion.

3. The automatic flushing mechanism of claim 2, wherein a gap is formed between the smooth toothless root portion and the curved rack when the smooth toothless portion faces the curved rack.

4. The automatic flushing mechanism of claim 2, wherein the intermittent motion gear rotates through a cycle comprising:

a lifting phase during which the toothed portion meshes with the curved rack and causes the curved rack to be lifted upward as the intermittent motion gear rotates; and a falling phase during which the smooth toothless root portion faces toward the curved rack and the intermittent motion gear is separated from the curved rack, causing the curved rack to fall downward.

5. The automatic flushing mechanism of claim 1, wherein a distance from an outer edge of the toothless top portion to a center of the intermittent motion gear is greater than a distance from the rim of the intermittent motion gear to the center of the intermittent motion gear.

6. The automatic flushing mechanism of claim 1, wherein the intermittent motion gear rotates through a cycle comprising:

a lifting phase during which the toothed portion meshes with the curved rack and causes the curved rack to be lifted upward as the intermittent motion gear rotates; and a holding phase during which the toothless top portion holds the curved rack in a lifted position.

7. The automatic flushing mechanism of claim 6, wherein the cycle further comprises a falling phase during which the intermittent motion gear disengages from the curved rack, causing the curved rack to fall downward.

8. The automatic flushing mechanism of claim 1, wherein:

the intermittent motion gear rotates in a first rotational direction; and the intermittent motion pendulum rod initially rotates in a second rotational direction opposite the first rotational direction as the intermittent motion gear rotates in the first rotational direction, and then switches to rotate in the first rotational direction as the intermittent motion gear continues to rotate in the first direction.

9. The automatic flushing mechanism of claim 1, wherein the automatic flushing mechanism is located within the water tank.

10. An automatic flushing mechanism, comprising:

an electric appliance control box comprising a motor;

an intermittent motion gear comprising a toothed portion provided along a rim of the intermittent motion gear, the toothed portion comprising at least one gear tooth, wherein the intermittent motion gear is driven by the motor; and an intermittent motion pendulum rod connected, on one end thereof, to a flush valve through a chain, and connected, on another end thereof, to a rotation shaft which is fixed on the electric appliance control box, wherein the intermittent motion pendulum rod is rotated around the rotation shaft and comprises a curved rack which meshes with the toothed portion of the intermittent motion gear, wherein the intermittent motion pendulum rod is provided with a groove which contains the intermittent motion gear, wherein the curved rack is provided on one side of the groove.

11. The automatic flushing mechanism of claim 10, further comprising a position-limit device which is fixed on the electric appliance control box and limits movement of the intermittent motion pendulum rod.

12. The automatic flushing mechanism of claim 10, wherein the intermittent motion gear comprises a smooth toothless root portion along the rim of the intermittent motion gear.

13. The automatic flushing mechanism of claim 12, wherein a gap is formed between the smooth toothless root portion and the curved rack.

14. An automatic flushing mechanism, comprising:

an electric appliance control box comprising a motor;

an intermittent motion gear comprising a toothed portion provided along a rim of the intermittent motion gear, the toothed portion comprising at least one gear tooth, wherein the intermittent motion gear is driven by the motor; and an intermittent motion pendulum rod connected, on one end thereof, to a flush valve through a chain, and connected, on another end thereof, to a rotation shaft which is fixed on the electric appliance control box, wherein the intermittent motion pendulum rod is rotated around the rotation shaft and comprises a curved rack which meshes with the toothed portion of the intermittent motion gear;

wherein:

the intermittent motion gear is rotated until the toothed portion meshes with the curved rack;

a tooth top arc of a first gear tooth which the toothed portion adopts to mesh with the curved rack is greater than a tooth top arc of any other gear tooth of the toothed portion; and a tooth top arc of a second rack tooth which the curved rack adopts to mesh with the toothed portion is greater than a tooth top arc of any other rack tooth of the curved rack.

15. The automatic flushing mechanism of claim 10, wherein:

the intermittent motion gear comprises a smooth toothless top portion adjacent to the toothed portion along the rim of the intermittent motion gear; and a distance from an edge of the toothless top portion to a center of the intermittent motion gear is greater than a distance from the rim of the intermittent motion gear to center of the intermittent motion gear.

16. The automatic flushing mechanism of claim 15, wherein a bottom tooth of the curved rack remains in contact with and slides along the toothless top portion as the intermittent motion gear rotates after the bottom tooth disengages from the toothed portion.

17. The automatic flushing mechanism of claim 15, wherein the toothless top portion occupies between one-half and three-fourths of the rim of the intermittent motion gear.

* * * * *